US009033572B2

(12) United States Patent
Keller

(10) Patent No.: US 9,033,572 B2
(45) Date of Patent: May 19, 2015

(54) AGITATOR FOR ABRASIVE MEDIA

(75) Inventor: Wolfgang Keller, Kembs (FR)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 719 days.

(21) Appl. No.: 12/598,698

(22) PCT Filed: Apr. 30, 2008

(86) PCT No.: PCT/EP2008/003522
§ 371 (c)(1),
(2), (4) Date: Nov. 3, 2009

(87) PCT Pub. No.: WO2008/135225
PCT Pub. Date: Nov. 13, 2008

(65) Prior Publication Data

US 2010/0118643 A1 May 13, 2010

(30) Foreign Application Priority Data

May 4, 2007 (DE) ..... 10 2007 021 056

(51) Int. Cl.
*B01F 7/26* (2006.01)
*B01F 3/12* (2006.01)
*B01F 7/00* (2006.01)

(52) U.S. Cl.
CPC ..... *B01F 3/1221* (2013.01); *B01F 7/00316* (2013.01); *B01F 7/00041* (2013.01); *B01F 7/00116* (2013.01); *B01F 7/00133* (2013.01); *B01F 7/00275* (2013.01); *B01F 7/00466* (2013.01)

(58) Field of Classification Search
CPC ..... B01F 7/00241; B01F 7/0025; B01F 7/00291; B01F 7/00316; B01F 7/0045; B01F 7/00466
USPC ..... 366/315–317, 330.3, 330.7, 343, 265, 366/270, 272, 325.3, 325.4, 325.92, 330.1, 366/300.7; 416/228, 243, 223 B
See application file for complete search history.

(56) References Cited

U.S. PATENT DOCUMENTS

| | | | | |
|---|---|---|---|---|
| 1,084,210 | A * | 1/1914 | Howard | 366/317 |
| 3,222,141 | A * | 12/1965 | Donaldson | 366/330.7 |
| 3,470,265 | A | 9/1969 | Sprow | |
| 3,526,467 | A | 9/1970 | Kime | |
| 3,920,227 | A | 11/1975 | Davis, Jr. | |
| 5,344,235 | A * | 9/1994 | Weetman et al. | 366/330.5 |
| 6,254,335 | B1 | 7/2001 | Ekholm et al. | |

(Continued)

FOREIGN PATENT DOCUMENTS

| | | |
|---|---|---|
| DE | 1 795 244 | 9/1959 |
| DE | 34 46 741 A1 | 7/1986 |

(Continued)

*Primary Examiner* — Timothy Cleveland
(74) *Attorney, Agent, or Firm* — Posz Law Group, PLC

(57) ABSTRACT

An agitator, particularly for abrasive media includes a support disk to which agitator blades are connected substantially perpendicular to the support disk. The blades are arranged substantially in a radial direction. The support disk also includes a hub that receives an agitator shaft which is preferably motor-driven. The trailing faces of the blades of the agitator and/or the area of the blade connections to the support disk are designed to largely prevent vortex shedding. This is accomplished by implementing a specific geometry for the agitator blades, the support disk, and the connection of the blades to the support disk.

26 Claims, 5 Drawing Sheets

(56) References Cited

U.S. PATENT DOCUMENTS

| | | | | |
|---|---|---|---|---|
| 6,325,532 | B1 | 12/2001 | King et al. | |
| 6,568,907 | B2 * | 5/2003 | Horng et al. | 416/228 |
| 6,637,926 | B1 | 10/2003 | Auad | |
| 6,712,582 | B1 * | 3/2004 | Lin et al. | 416/228 |
| 2005/0007874 | A1 | 1/2005 | Roszczenko et al. | |

FOREIGN PATENT DOCUMENTS

| | | | |
|---|---|---|---|
| DE | 36 35 642 | | 4/1988 |
| DE | 203 13 722 | U1 | 1/2004 |
| DE | 102005058724 | | 6/2006 |
| EP | 1 776 999 | | 4/2007 |
| EP | 1 911 511 | A | 4/2008 |
| GB | 2 034 187 | | 6/1980 |
| JP | 57-59625 | | 4/1982 |
| WO | WO 02/22247 | | 3/2002 |
| WO | WO 2006/057560 | | 6/2006 |
| WO | WO 2007/013415 | | 2/2007 |
| WO | WO 2008/083673 | | 7/2008 |

* cited by examiner

AGITATOR FOR ABRASIVE MEDIA

CROSS-REFERENCES TO RELATED APPLICATIONS

This application is the U.S. National Stage of International Application No. PCT/EP2008/003522, filed Apr. 30, 2008, which designated the United States and has been published as International Publication No. WO 2008/135225 and which claims the priority of German Patent Application, Serial No. 10 2007 021 056.8, filed May 4, 2007, pursuant to 35 U.S.C. 119(a)-(d).

BACKGROUND OF THE INVENTION

The invention relates to an agitator which is particularly intended for abrasive media. Increased wear due to abrasion occurs when abrasive media are stirred, such as suspensions with high concentrations of solid matter which may occur, for example, when processing ore in, for example, oxidation autoclaves for refining gold and copper, so that the agitator has only relatively short operating times before it must be replaced.

Attempts have been made to apply coatings of abrasion-resistant materials, for example hard metals, metal carbides or the like, on the agitators for reducing abrasion. Such coatings are not only extremely expensive, but application of the coatings can also partially weaken the support material, which may cause additional problems. Extremely corrosive conditions are present particularly when processing ore using wet-chemical processes, which necessitates the use of particularly resistant materials, such as titanium compositions, for the support material. However, such coatings which improve the wear resistance frequently do not exhibit sufficient chemical resistance, so that they can be removed by corrosion.

So-called disk agitators represent one particular type of radially conveying agitator; disk agitators include a support disk to which several agitator blades are attached. The agitator blades are attached to the support disk in a substantially perpendicular and radial direction. The support disk in this type of disk agitator is oriented substantially horizontally, and the agitator blades are attached to the support disk at about half the blade height. Disk agitators having this design can have a different number of agitator blades and/or the agitator blades can have blade surfaces of different sizes.

SUMMARY OF THE INVENTION

It is an object of the invention to provide an agitator, in particular for abrasive media, with a support disk, wherein agitator blades are attached to the support disk in a substantially vertical and substantially radial direction relative to the support disk, and which has a hub for receiving an agitator shaft, wherein the agitator is designed to resist abrasion and has a longer operating time when used as designed.

According to the invention, an agitator, in particular for abrasive media, with a support disk is provided, to which agitator blades are attached in a substantially perpendicular and substantially radial direction relative to the support disk, and which has a hub for receiving an agitator shaft, wherein the agitator is characterized in that the sides of the agitator blades and/or the region of the blade attachment to the support disk are formed so as to substantially prevent vortex shedding.

With the agitator of the invention, the geometry of the agitator is selected and adjusted in the region of the support disk, of the agitator blade, of the agitator blade attachment and of the agitator hub or the like so as to reduce abrasion and improve the operating time, with the result that the wear characteristic due to abrasion can be significantly reduced or even completely eliminated even when the abrasive media have high concentrations of solid matter, a large applied agitator power and high circumferential speeds. The geometry of the agitator of the invention hereby is changed and optimized to attain agitators which have longer operating times, thus reducing maintenance and replacement intervals of the agitators, so that facility downtimes can be significantly shortened.

Preferably, for a design which effectively prevents vortex shedding, the respective agitator blade has a pitch angle β with respect to the radial direction from about 10° to 60°, preferably from about 20° to 50°. This prevents shedding of vortices on the agitator blades, thereby improving the flow pattern around the blades and hence also significantly improving the abrasion resistance of the agitator.

According to a preferred alternative embodiment of the invention, the geometry of the agitator blade is constructed so as to substantially prevent vortex shedding, i.e., the geometry of the agitator blade itself is optimized, particularly on the side facing away from the flow. This reduces or prevents impact and sliding abrasion on the trailing end of the agitator blades, so that such agitator becomes more wear resistant.

According to a preferred embodiment of the invention, the respective agitator blade has a radius (R) in the region where the blade is attached to the support disk, with the radius facing the flow direction. This radius R has preferably a value of $R=(0.1-1.0)\times$diameter of the agitator. Changing the shape of the respective agitator blades can more effectively prevent vortex shedding, wherein extremely advantageous and wear-resistant flow patterns around the blades are obtained particularly in combination with a corresponding pitch of the agitator blades in the radial direction having the aforementioned angular ranges.

According to an alternative or additional embodiment, the agitator blades of the agitator of the invention may be attached with one side on the support disk, so that the support disk protects the agitator blades against impact and sliding wear particularly in the trailing edge region. Optionally, not only the shape of the support disk can be altered in a suitable manner, but also the number of the support disk parts or support disk elements, whereby the support disk may preferably be designed to substantially prevent vortex shedding in the attachment region of the agitator blades, and/or the support disk may include several support disk parts.

According to an alternative or additional preferred embodiment of the invention, the support disk may include a recess on the side of the agitator blades facing away from the flow, for reducing the wear surface for the abrasive effects on the support disk and on the attachment location of the agitator blades.

According to a preferred embodiment of the invention, a flow around the agitator blades with unfavorable vortex formation can be prevented by arranging wing-shaped elements on the inner edge of the agitator blades.

Optionally, the agitator blade may be completely or at least partially coated with an abrasion-resistant material at those locations that are at risk of being abraded. This can further improve the operating time and the resilience of such agitator even under extremely severe operating conditions.

In summary, it is important for the agitator according to the invention that improvements are attained with the help of geometric means at those locations that are at risk of being abraded, e.g., the sides of the agitator blades facing away from the flow and/or in the regions where the blade is attached to the support disk, which result in a design that is substantially free from vortex shedding. With these measures, in particular impact and sliding wear can be substantially reduced when such agitator is used as intended, in particular a radial conveyor in form of a disk agitator, and the operating times of such agitator can be improved without requiring additional time-consuming and expensive measures on the agitator, such as coatings and the like. With the solutions according to the invention, in particular those measures are proposed which allow a reduction of vortex shedding which is detrimental for the wear characteristic and establish more advantageous flow conditions around the blades, without adversely affecting the basic efficiency of such agitator. The invention can suppress the wear mechanism by altering the shape of the agitator, producing an agitator with extended operating times and significant savings for maintenance and system downtimes. It will be understood that the agitator with the improved geometry should not have a lower efficiency.

BRIEF DESCRIPTION OF THE DRAWING

The invention will now be described in more detail with reference to preferred embodiments which are not to be viewed as limiting, and with reference to the appended drawing. In the drawings, the embodiments of the agitators are illustrated in a corresponding FIG. in a top view and underneath in a side view. In the drawing.

DETAILED DESCRIPTION OF PREFERRED EMBODIMENTS

The rotation direction of the agitator shaft and hence of the support disk are indicated in the figures of the drawings by an arrow.

In addition, if applicable, identical or similar elements are indicated in the figures of the drawings with identical reference symbols.

Figure 1:
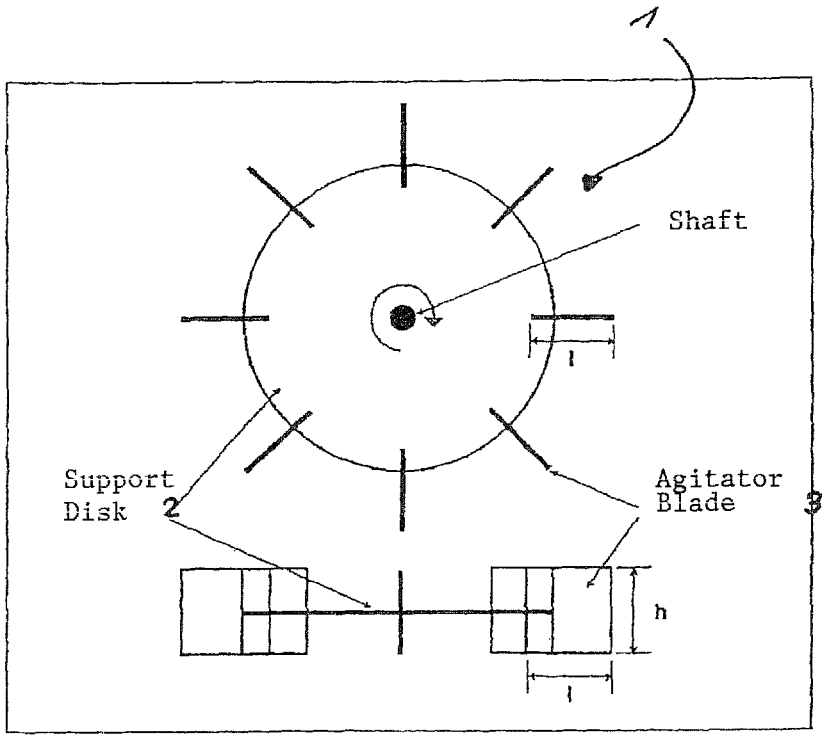
FIG. 1 shows a conventional embodiment of an agitator in the form of a radially conveying disk agitator.

FIG. 1 shows in a schematic diagram an exemplary radially conveying agitator, a so-called disk agitator of conventional design. The agitator designated with the reference symbol 1 includes a preferably horizontally oriented support disk 2, with several agitator blades 3 attached to the support disk 2 perpendicular and in a substantially radial direction. In the illustrated embodiment, the agitator blades 3 are straight and have a rectangular shape. The agitator blades 3 are arranged symmetrical about the circumference of the support disk 2. Each rectangular agitator blade 3 has a height h and a length l. In the illustrated example, the agitator blades 3 are attached on the support disk 2 at about half the blade height h. Such agitator 1 has a favorable dispersing effect, in particular with gas flow, and produces a primarily radial flow direction with a corresponding pumping efficiency and a substantial gas dispersing ability FIGS. 2 to 9 show particularly preferred geometric modifications of such agitator according to the invention. It is important that this agitator design of the invention with modified geometry shows no detrimental effects, either with respect to the primary flow direction, the pumping efficiency, the applied power or the gas dispersing ability.

Figure 2:
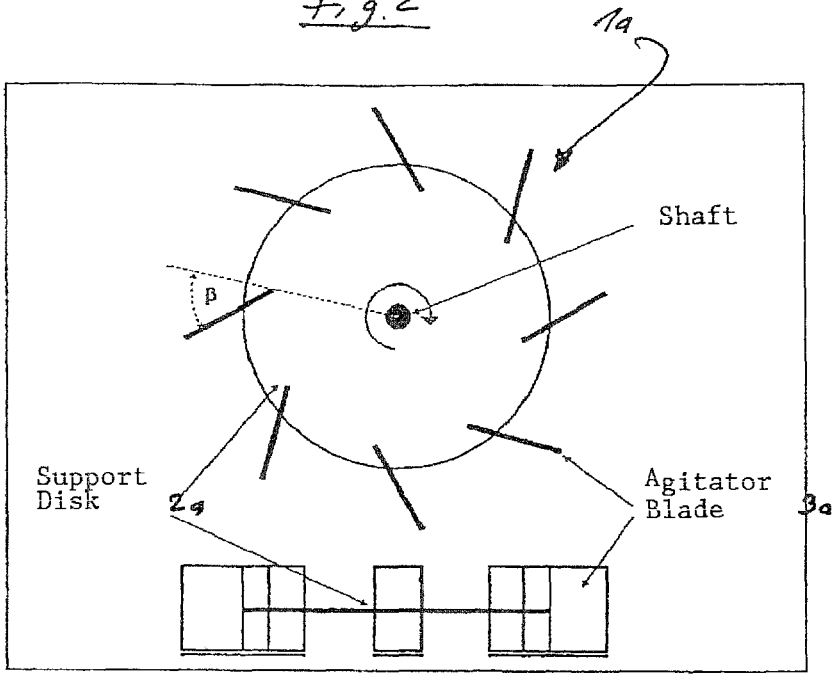
FIG. 2 shows an embodiment of a shape of an agitator according to the invention in a first preferred embodiment.

In the configuration of the agitator 1*a* according to the invention illustrated in FIG. 2, the agitator blades 3*a* have a pitch angle β with respect to the radial direction, which is in the range of about 10° to 50°, preferably in a range from about 20° to 50°. With this radial pitch angle of the agitator blades 3*a*, vortex shedding, in particular on the trailing side of the agitator blades 3, can be prevented, so that the agitator 1*a* exhibits more advantageous flow conditions in the region of the agitator blades 3*a* and where the agitator blades 3*a* are attached to the support disk 2*a*.

Figure 3:
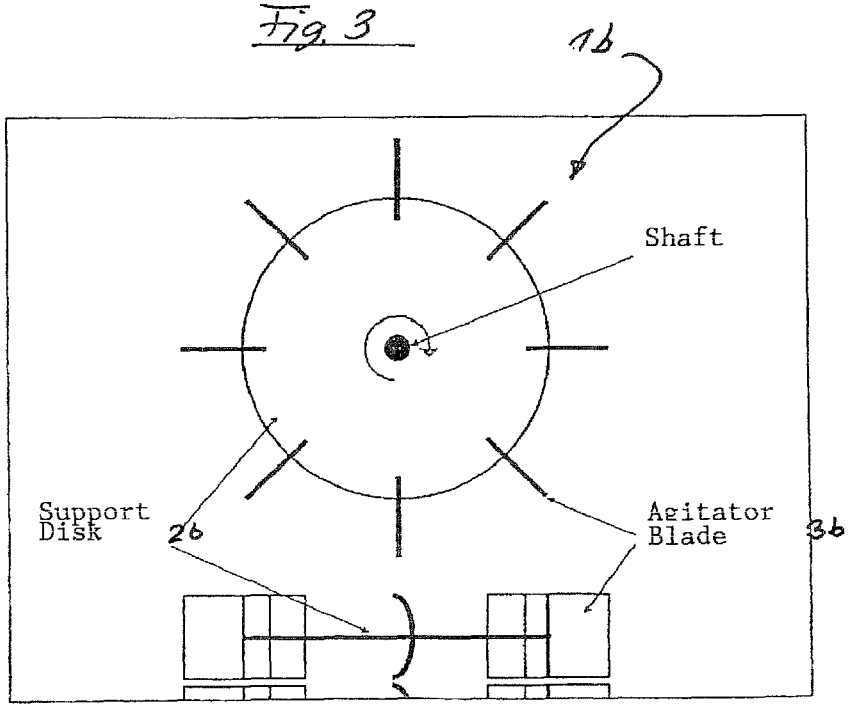
FIG. 3 shows another embodiment of an agitator according to the invention with a changed blade shape of the agitator blades.

In the configuration of the agitator 1*a* according to FIG. 3, the blade shape of the agitator blades 3*a* is optimized and changed accordingly, as can be seen more clearly from the bottom diagram in FIG. 3. With a corresponding design of the agitator blades 3*b*, vortex shedding can be prevented and more advantageous flow conditions around the agitator blades 3*b* and the associated attachment regions of the agitator blades 3*b* on the support disk 2*b* can be attained.

Figure 4:
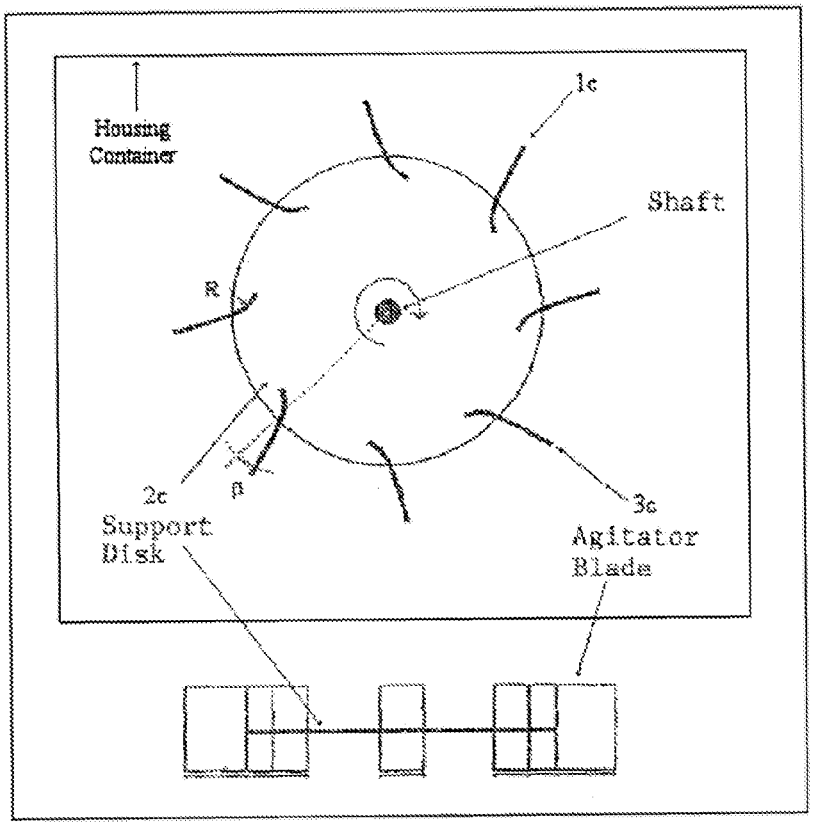
FIG. 4 shows another preferred embodiment with a changed blade shape and a pitch of the agitator blades in the radial direction.

FIG. 4 shows an embodiment of an agitator 1*c*, where the agitator blades 3*c*, like in FIG. 2, are oriented at a pitch angle β relative to the radial direction, wherein for improving the flow around the blades and for preventing vortex shedding the agitator blades 3*c* have a radius R in the attachment region on the support disk 2*c*, which is preferably in a range of R=(0.1–1.0)×diameter of the agitator. The diameter of the agitator is the largest outside diameter of the agitator 1*c*, including the outermost ends of the agitator blades 3*c*.

Figure 5:
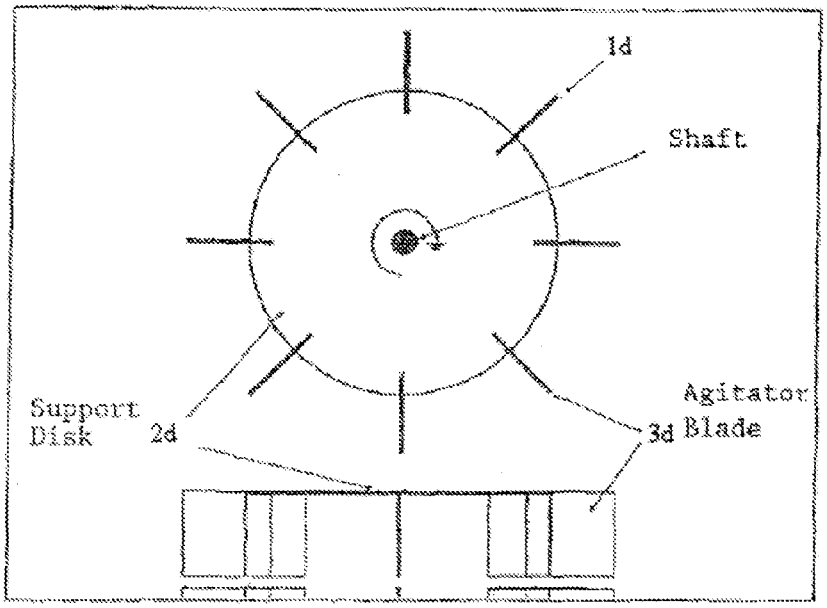
FIG. 5 shows another embodiment of the agitator according to the invention with a changed attachment of the agitator blades on the support disk.
Figure 6:
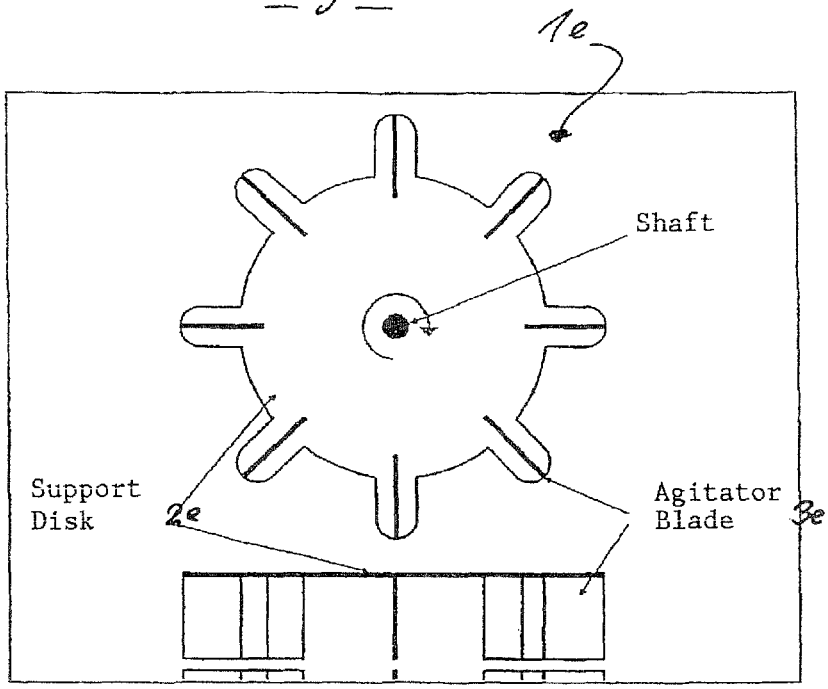
FIG. 6 shows another embodiment of the agitator according to the invention with a changed embodiment of a support disk.
Figure 7:
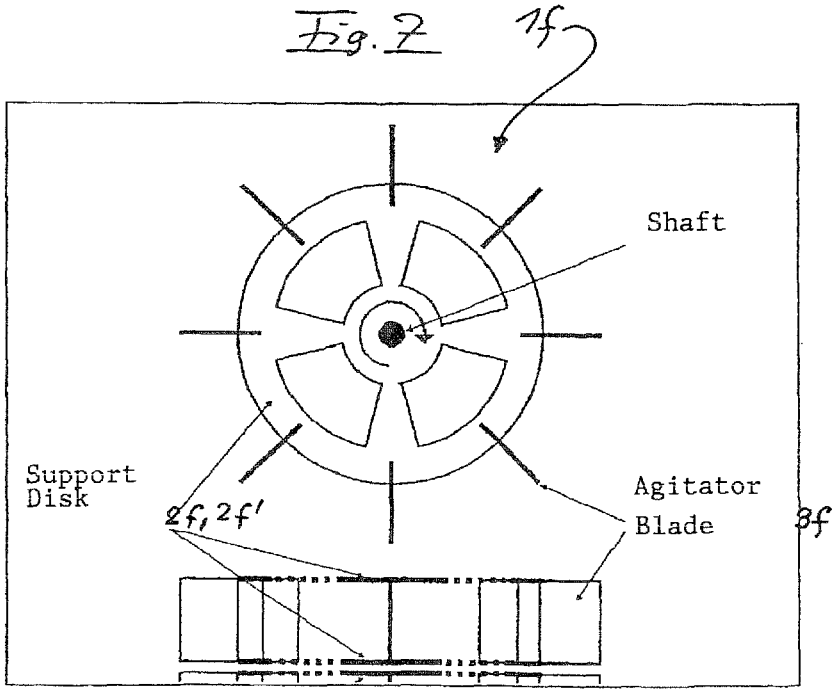
FIG. 7 shows another embodiment of the agitator according to the invention with a modified design of the support disk.

FIGS. 5 to 7 describe modified embodiments of agitators 1*d* to 1*f*, wherein the respective agitator blades 3*d* to 3*f* are attached with one side on the associated support disk 2*d* to 2*f*. The corresponding support disk 2*d* to 2*f* forms a cover for the attached agitator blades 3*d* to 3*f*, thereby preventing flow around the agitator blades 3*d* to 3*f*. In the embodiment of FIG. 5, radially arranged agitator blades 3*d*, which are substantially oriented in the radial direction, are attached on an end face of the support disk 2*d*.

In the embodiment of the agitator 1*e* according to FIG. 6, the shape and in particular the outside contour of the support disk 2*e* is changed and adapted, and at the same time, the agitator blades 3*e* are attached substantially radially with one side of the support disk 2*e*. This produces an advantageous effect similar to that of the embodiment of FIG. 5.

In the modified embodiment according to FIG. 7, the agitator 1*f* has several support disk parts 2*f* and 2*f*', which in combination form the support disk. These two support disk parts 2*f* and 2*f*' each form the outside contour of the agitator 1*f* as seen in the axial direction, wherein both sides of the agitator blades 3*f* are attached to and covered by the support disk parts 2*f* and 2*f'*. This also helps to prevent wear-producing flow around the agitator blades 3*f*.

Accordingly, FIGS. 5 to 7 show embodiments of agitators 1*d* to 1*f* where, on one hand, the shape of the support disk 2*e* (shown in FIG. 6) or, on the other hand, the number of support disk parts 2*f*, 2*f'* (see FIG. 7) are varied.

Figure 8:
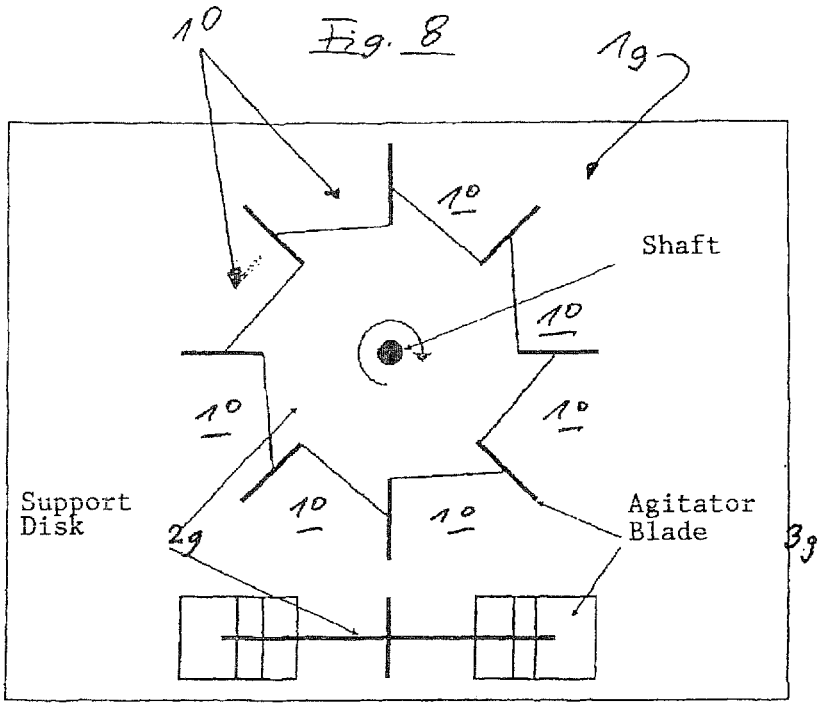
FIG. 8 shows an alternative preferred embodiment of an agitator according to the invention with a partially modified support disk and optimized attachment points of the agitator blades on the support disk.

FIG. 8 shows a modified embodiment of an agitator 1*g*, wherein the geometry and the size of the support disk 2*g* are changed. Recesses 10 are provided on the support disk 2*g* on the side of the agitator blades 3*g* facing away from the flow, thereby reducing the area of the wear surfaces for abrasion.

Figure 9:
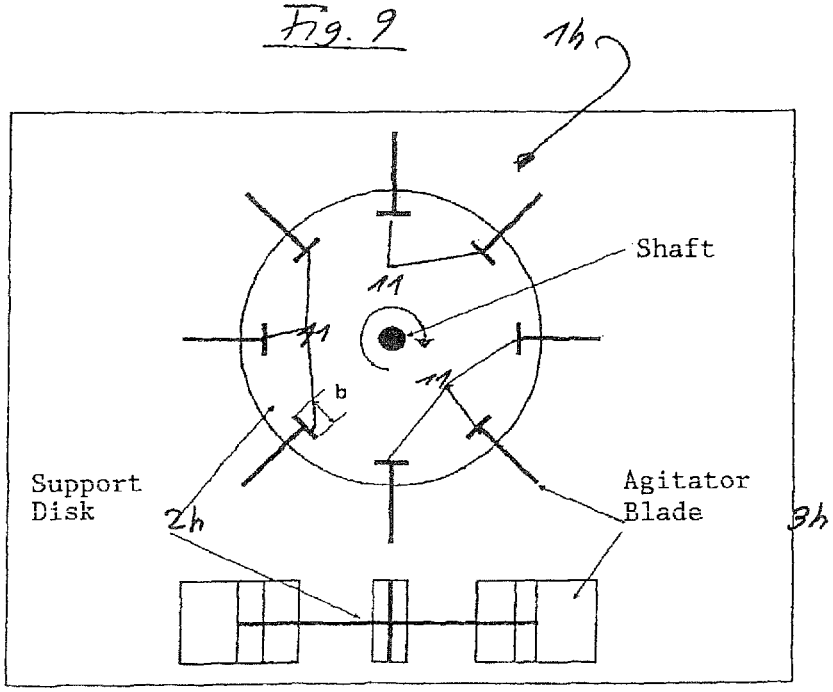
FIG. 9 shows another preferred embodiment of an agitator according to the invention with additional measures for improving the flow around the agitator blades on the inside edge of a blade.

As seen in FIG. 9, which shows another modified embodiment of an agitator 1*h*, wing-shaped elements 11 are attached on the inside edge of the agitator blades 3*h*, with the wing-shaped elements 11 being oriented substantially perpendicular to the radial span of the agitator blades 3*h* and having a corresponding length b. These wing-shaped elements 11 prevent flow around the agitator blades 3*h* which causes adverse vortex characteristics.

Although different, separate changes in the geometry of support disk 2*a* to 2*h* and/or changes in the design geometry of the agitator blades 3*a* to 3*h* were described above with reference to FIGS. 2 to 9, these measures can also be combined, depending on the desired application and the actual situation. The invention is therefore not limited to the features and details described above with reference to the preferred embodiments illustrated in FIGS. 2 to 9, but combinations thereof are possible, which are suitable for effectively and permanently reducing wear on those sides of the agitator blades 3*a* to 3*h* that face away from the flow, and/or on the support disk 2*a* to 2*h* in the region where the blades are attached. The agitators 3*a* to 3*h* are configured so as to prevent vortex formation and a resulting impact and sliding wear, in particular in the trailing region of the agitator blades 3*a* to 3*h* and at those locations where the agitator blades 3*a* to 3*h* are attached to the support disk 2*a* to 2*h*.

What is claimed is:

1. An agitator for abrasive media having a direction of rotation, comprising:

a circular support disk defining a radial direction, a periphery and an axial direction;

a plurality of agitator blades attached to the support disk and having blade surfaces with a concave curvature in the direction of rotation, each of the plurality of agitator blades connected to the support disk with a portion of the agitator blade protruding outwardly from a periphery of the support disk in a direction offset from the radial direction, wherein the concave surface of each outwardly protruding agitator blade forms in the direction of rotation an angle of between about 100° and 150° with a peripheral tangential direction along the periphery of circular support disk where each agitator blade intersects the periphery of the support disk, and wherein a portion of each agitator blade extending inwardly from the periphery of the support disk has a radius of curvature in the region where the agitator blades are attached to the support disk of between 0.1 and 1.0 times a diameter of the support disk, and a hub for receiving an agitator shaft, wherein the abrasive media is a suspension.

2. The agitator of claim 1, wherein the angle with the peripheral tangenital direction of each of the plurality of agitator blades is between about 110° and 140°.

3. The agitator of claim 1, wherein one side of the agitator blades is attached on the support disk.

4. The agitator of claim 1, wherein the support disk comprises several support disk parts.

5. The agitator of claim 1, wherein the support disk has a recess on the side of the agitator blades that faces away from flow.

6. The agitator of claim 1, wherein the agitator blades further comprise wing-shaped elements that are arranged on an inside edge of the agitator blades.

7. The agitator of claim 1, wherein the plurality of agitator blades are at least partially coated with an abrasion-resistant material.

8. The agitator of claim 1, wherein the agitator blades are attached to the support disk at about half a blade height.

9. The agitator of claim 1, wherein the agitator is constructed in absence of a housing.

10. The agitator of claim 1, wherein the agitator is constructed at least in part of a titanium composition.

11. The agitator of claim 1, wherein the suspension has a high concentration of solid matter.

12. The agitator of claim 1, wherein the abrasive media is a suspension with a high concentration of solid matter.

13. A system comprising:

a container for accommodating an abrasive medium, and an agitator having a direction of rotation, the agitator comprising:

a circular support disk defining a radial direction, a periphery and an axial direction;

a plurality of agitator blades attached to the support disk and having blade surfaces with a concave curvature in the direction of rotation, each of the plurality of agitator blades connected to the support disk with a portion of the agitator blade protruding outwardly from a periphery of the support disk in a direction offset from the radial direction, wherein the concave surface of each outwardly protruding agitator blade forms in the direction of rotation an angle of between about 100° and 150° with a peripheral tangential direction along the periphery of circular support disk where each agitator blade intersects the periphery of the support disk, and wherein a portion of each agitator blade extending inwardly from the periphery of the support disk has a radius of curvature in the region where the agitator blades are attached to the support disk of between 0.1 and 1.0 times a diameter of the support disk, and a hub for receiving an agitator shaft, wherein the abrasive medium is a suspension.

14. The system of claim 13, wherein the container is constructed as a pressure container.

15. The system of claim 13, wherein the container is constructed as an autoclave.

16. The system of claim 13, wherein the container is constructed as an oxidation autoclave.

17. The system of claim 13, wherein the abrasive medium is disposed inside the container.

18. The system of claim 13, wherein the suspension has a high concentration of solid matter.

19. The system of claim 13, wherein the abrasive medium is a suspension with a high concentration of solid matter.

20. A system for processing ore, comprising an agitator for an abrasive medium having a direction of rotation, the agitator comprising:

a circular support disk defining a radial direction, a periphery and an axial direction;

a plurality of agitator blades attached to the support disk and having blade surfaces with a concave curvature in the direction of rotation, each of the plurality of agitator blades connected to the support disk with a portion of the agitator blade protruding outwardly from a periphery of the support disk in a direction offset from the radial direction, wherein the concave surface of each outwardly protruding agitator blade forms in the direction of rotation an angle of between about 100° and 150° with a peripheral tangential direction along the periphery of circular support disk where each agitator blade intersects the periphery of the support disk, and wherein a portion of each agitator blade extending inwardly from the periphery of the support disk has a radius of curvature in the region where the agitator blades are attached to the support disk of between 0.1 and 1.0 times a diameter of the support disk, and a hub for receiving an agitator shaft, wherein the abrasive medium is a suspension.

21. The system of claim 20, further comprising a container for accommodating an abrasive medium.

22. The system of claim 21, wherein the container is constructed as a pressure container.

23. The system of claim 21, wherein the container is constructed as an autoclave.

24. The system of claim 21, wherein the container is constructed as an oxidation autoclave.

25. The system of claim 20, wherein the suspension has a high concentration of solid matter.

26. The system of claim 20, wherein the abrasive medium is a suspension with a high concentration of solid matter.

* * * * *